US006584944B2

(12) United States Patent
Sluka et al.

(10) Patent No.: US 6,584,944 B2
(45) Date of Patent: Jul. 1, 2003

(54) APPARATUS FOR RELATIVE ANGULAR ADJUSTMENT OF A CRANKSHAFT OF A COMBUSTION ENGINE WITH RESPECT TO A DRIVING WHEEL AND METHODS OF MAKING AND OPERATING SAME

(75) Inventors: Gerold Sluka, Neckartailfingen (DE); Edwin Palesch, Lenningen (DE); Ralf Naumann, Grossbettlingen (DE)

(73) Assignees: Dr. Ing. h.c.F. Porsche AG, Stuttgart (DE); Hydraulik Ring GmbH, Automobiltechnik, Limbach-Oberfrohna (DE)

( * ) Notice: Subject to any disclaimer, the term of this patent is extended or adjusted under 35 U.S.C. 154(b) by 0 days.

(21) Appl. No.: 09/930,481

(22) Filed: Aug. 16, 2001

(65) Prior Publication Data

US 2002/0026916 A1 Mar. 7, 2002

(30) Foreign Application Priority Data

Aug. 16, 2000 (DE) ..... 100 39 913

(51) Int. Cl.[7] ..... F01L 1/34

(52) U.S. Cl. ..... 123/90.17; 123/90.15; 74/568 R

(58) Field of Search ..... 123/90.12, 90.15, 123/90.17, 90.31; 74/568 R; 464/1, 2, 160

(56) References Cited

U.S. PATENT DOCUMENTS

| | | | | |
|---|---|---|---|---|
| 6,053,139 A | | 4/2000 | Eguchi et al. | |
| 6,129,063 A | * | 10/2000 | Niethammer et al. | 123/90.17 |
| 6,283,075 B1 | * | 9/2001 | Schafer et al. | 123/90.17 |
| 6,311,655 B1 | * | 11/2001 | Simpson et al. | 123/90.17 |

FOREIGN PATENT DOCUMENTS

| | | |
|---|---|---|
| DE | 196 23 818 | 12/1996 |
| JP | 11 311110 | 11/1999 |
| JP | 11 343819 A | 12/1999 |
| JP | 2000 227010 | 8/2000 |

* cited by examiner

*Primary Examiner*—Thomas Denion
*Assistant Examiner*—Jaime Corrigan
(74) *Attorney, Agent, or Firm*—Crowell & Moring LLP

(57) ABSTRACT

An arrangement for the relative angle-of-rotation adjustment of a camshaft with respect to a driving wheel has an interior part which is non-rotatably connected with the camshaft. A driven cell wheel has several cells which are distributed along the circumference and are bounded by webs and can be divided into two pressure spaces by the webs or blades guided therein in an angularly movable manner. At least one locking device, which is operative between the interior part and the cell wheel, can lock the interior part with respect to the cell wheel in at least one end position. At least one blade of the interior part has a head part having at least one locking element which interacts with a locking structure provided on at least one web of the cell wheel.

21 Claims, 9 Drawing Sheets

APPARATUS FOR RELATIVE ANGULAR ADJUSTMENT OF A CRANKSHAFT OF A COMBUSTION ENGINE WITH RESPECT TO A DRIVING WHEEL AND METHODS OF MAKING AND OPERATING SAME

BACKGROUND AND SUMMARY OF THE INVENTION

This application claims the priority of German Application No. 100 39 913.4, filed Aug. 16, 2000, the disclosure of which is expressly incorporated by reference herein.

The invention relates to an arrangement for the relative angle-of-rotation adjustment of a camshaft of an internal-combustion engine with respect to a driving wheel having an interior part which is non-rotatably connected with the camshaft and which has at least approximately radially extending blades, a driven cell wheel which has cells which are distributed along a circumference, are bounded by webs and can be divided into two pressure spaces by the blades guided in the cells in an angularly movable manner, during the admission or discharge of hydraulic pressure to or from the pressure spaces by way of control lines, the camshaft being rotatable by way of the blades between two end positions relative to the cell wheel, and at least one locking device which is operative between the interior part and the cell wheel whereby the interior part can be locked with respect to the cell wheel in at least one of the end positions.

From German Patent Document DE 196 23 818 A1, an arrangement of the above-mentioned type is known, in which, by means of a locking element arranged in the rotor of the camshaft adjusting device, the camshaft adjusting device can be locked in an end position. The locking element constructed as a locking bolt is disposed in the rotor of the camshaft adjusting device and can be displaced parallel to the axis of rotation of the rotor. By way of an opening arranged in the stator of the camshaft adjusting device, the locking bolt can be changed into its locking position. The construction of this locking device requires relatively high expenditures. The locking device also requires a highly precise fit, so that the locking bolt can be changed into its locking position in a secure fashion.

It is an object of the invention to improve an arrangement of the above-mentioned type for the relative angle-of-rotation adjustment of a camshaft with respect to its driving wheel such that a simple, operationally reliable locking unit for a camshaft adjusting device is created which has few additional components.

According to certain preferred embodiments of the invention, this object is achieved by providing at least one of the blades of the interior part with a head part having at least one locking element which interacts with a locking structure of the cell wheel and is changeable as a function of operating parameters from a locked position into an unlocked position.

The locking unit according to certain preferred embodiments of the invention is distinguished by a simple construction, in which a reliable locking unit is created in a simple manner particularly by a modification of the already existing components. At least a portion of the operating forces required for the unlocking can be applied by the centrifugal force generated during the rotation of the camshaft. An assisting hydraulic unlocking force is implemented in a simple manner by a hydraulic line leading to the blade element of the interior part. As a result of the admission of pressure to the hydraulic line, the radially longitudinally displaceable head part of the blade can be changed against a spring force from a locked position into an unlocked position.

A certain preferred embodiment of the invention is explained in detail in the following description and in the drawings.

Other objects, advantages and novel features of the present invention will become apparent from the following detailed description of the invention when considered in conjunction with the accompanying drawings.

DETAILED DESCRIPTION OF THE DRAWINGS

Figure 1:
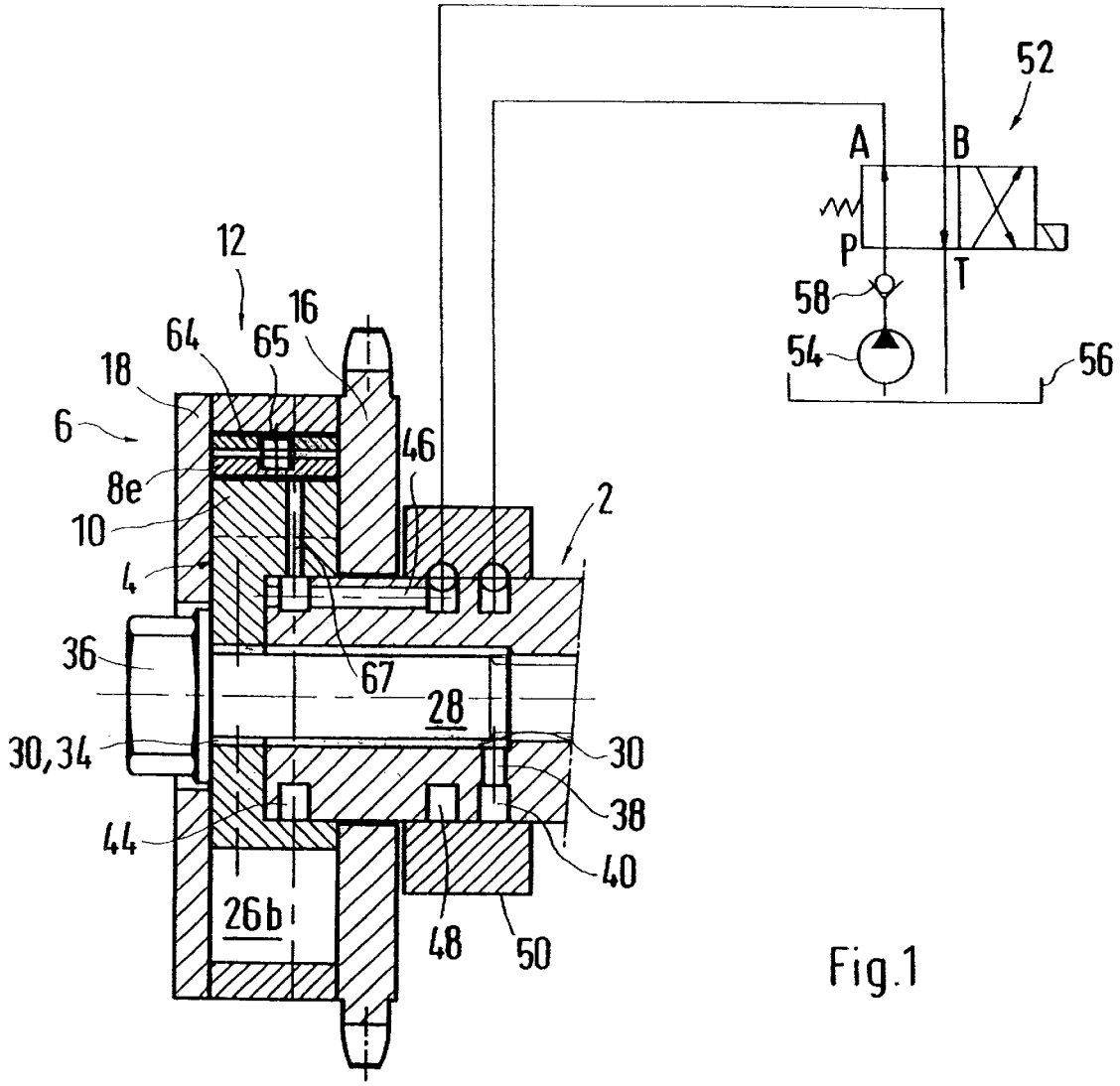
FIG. 1 shows a longitudinal sectional view of the adjusting unit with its supply unit.

In FIG. 1, the camshaft of an internal-combustion engine is schematically indicated by reference number 2. At the free end of the camshaft 2, the rotor—in the following called interior part 4—of an adjusting unit 6 is non-rotatably arranged. In this embodiment, the interior part 4 is equipped with five radially arranged blades 8*a* to 8*e* which start out from a hub 10 of the interior part 4. In the area of its blades 8*a* to 8*e,* a cell wheel 12 reaches around the interior part 4, which cell wheel 12 is provided with five inward-projecting radial webs 14 to 14*e*. The cell wheel 12, which represents the stator of the adjusting unit 6, is closed off by a chain wheel 16 on its face directed to the camshaft 2. This chain wheel 16 is rotatably and sealingly guided on the hub 10 of the interior part 4. The chain wheel 16 is used as a drive for the camshaft 2 which takes place, for example, by way of a driving chain connected with the crankshaft. The opposite face of the cell wheel 12 is closed by a disk 18, the chain wheel 16 and the disk being fixedly connected by way of fastening screws 20 with the cell wheel 12. The passage bores 22 provided in the webs 14*a* to 14*e* in the cell wheel 12 are used for accommodating or guiding these fastening screws 20.

By way of the webs 14*a* to 14*e* of the cell wheel 12, five cells are formed which are bounded in the axial direction by the chain wheel 16 and the disk 18 and which are divided by the blades 8*a* to 8*e* of the interior part 4 into two pressure spaces 24*a* to 24*e* and 26*a* to 26*e* respectively. The interior part 4 and the cell wheel 12 rotatably guided thereon are mutually connected by a screw 28. For this purpose, the hub 10 and the camshaft 2 have a central bore 30.

The pressure spaces 24*a* to 24*e* are in each case connected with an annulus 34 by way of bores 32*a* to 32*e* extending radially in the hub 10 of the interior part 4. This annulus 34 forms between the fastening screw 28 for the adjusting unit 6 and the wall sections of the central bore 30 provided in the hub 10 and the camshaft 2, the annulus 34 being closed on the end side by the head 36 of the screw 28. The annulus 34 is connected by way of several bores 38 made radially in the camshaft 2 with a ring groove 40 arranged at the outer circumference of the camshaft 2. The pressure spaces 26*a* to 26*e* are connected by way of bores 42*a* to 42*e* extending radially in the hub 10 of the interior part 4 with a ring groove 44 arranged on the outer circumference of the camshaft, which lead by way of five bores 46*a* to 46*e* axially arranged in the camshaft 2 to another ring groove 48 also constructed on the outer circumference of the camshaft 2.

Figure 1A:
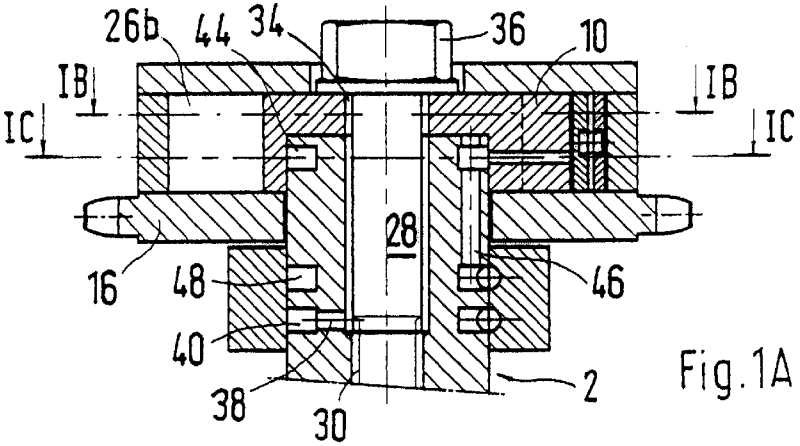
FIG. 1*a* shows a longitudinal sectional view of the adjusting unit in the locked position.
Figure 1B:
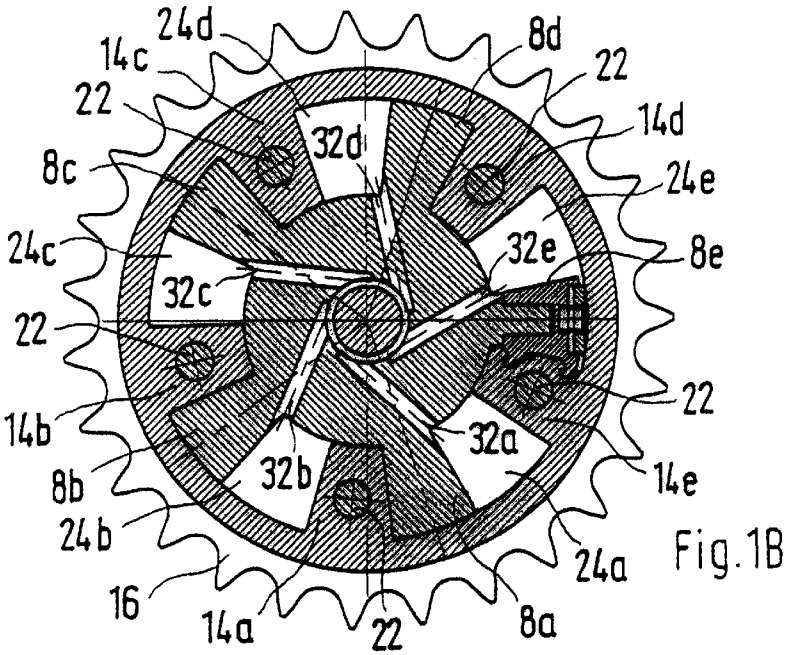
FIG. 1*b* shows a sectional view along line IB—IB in FIG. 1*a;*
Figure 1C:
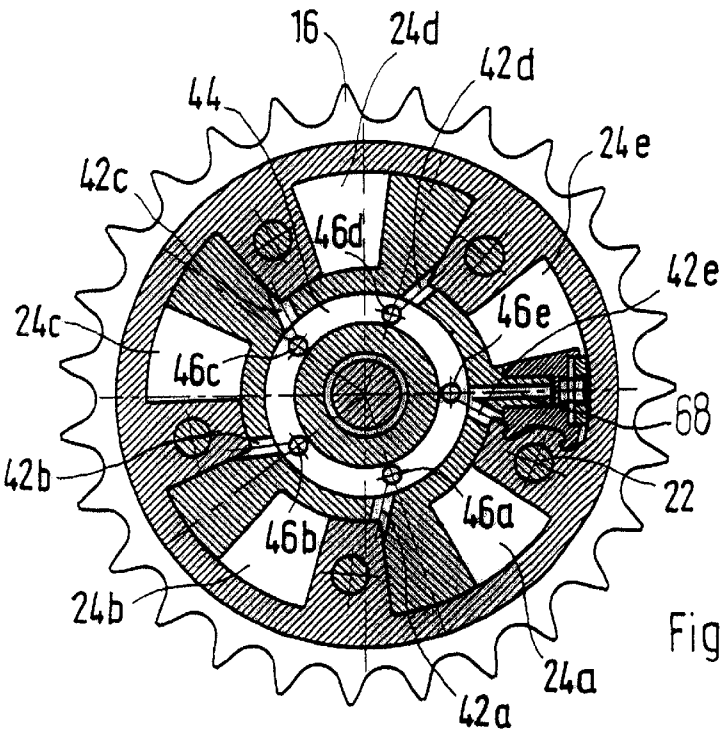
FIG. 1*c* shows a sectional view along Line IC—IC in FIG. 1*a;*

The two ring grooves 40, 48 are each connected by way of a camshaft bearing 50 acting as a rotary transmission lead through with a control line A and B. The two control lines A and B are connected with a control valve 52 which is constructed, for example, as a 4/2-proportional control valve. Furthermore, this control valve 52 is connected with a pressure medium pump 54 and an oil tank 56. Directly behind the pressure medium pump 54, a return valve 58 is arranged in the pressure pipe P. In a preferred embodiment, the adjusting unit 6, with its locked end position illustrated in FIGS. 1*a*–1*c*, is provided for the adjustment of an outlet camshaft, in which case the cell wheel 12 is driven clockwise, while the interior part 4 can be adjusted counterclockwise in the direction of a "late" opening of the outlet valves.

For locking the interior part 4 with respect to the cell wheel 12 in an end position of the adjusting unit 6 illustrated according to FIG. 1, the blade 8*e* of the interior part 4, in an interaction with the web 14*e* of the cell wheel 12, is constructed as a locking unit which will be described in detail in the following.

The blade 8*e* has a head part 58 which is disposed by way of a groove-shaped recess 59 in a radially longitudinally displaceable manner on a shank part 60 of the blade 8*e* constructed as a flat pin. The contour of one lateral surface of the head part 58 has two hook-shaped elements 61 which, in the locked position of the camshaft adjusting device, engage in two openings 62 adapted corresponding to the contour of the hook-shaped elements 61. The face of the head part 58 has a rectangular recess 63 into which a plate element 64 engages. The plate element 64 is pressed by way of a pressure spring 65 against the interior wall 66 of the cell wheel 12. For receiving the pressure spring 65, bores 67 are provided on the face of the head part 58 and in the plate element 64. The plate element 64 is used, on the one hand, as a sealing device between the two pressure spaces 24*e* and 26*e* and, on the other hand, as a support or guide for a radial longitudinal displacement of the head part 58. A supply duct 68 is arranged in the shank part 60 of the blade 8*e*, which supply duct 68 is supplied with pressure oil by way of the ring groove 44 and the bore 46*e*.

In the following, a complete adjusting operation of the adjusting unit 6 will be described by way of the figures.

Figure 5A:
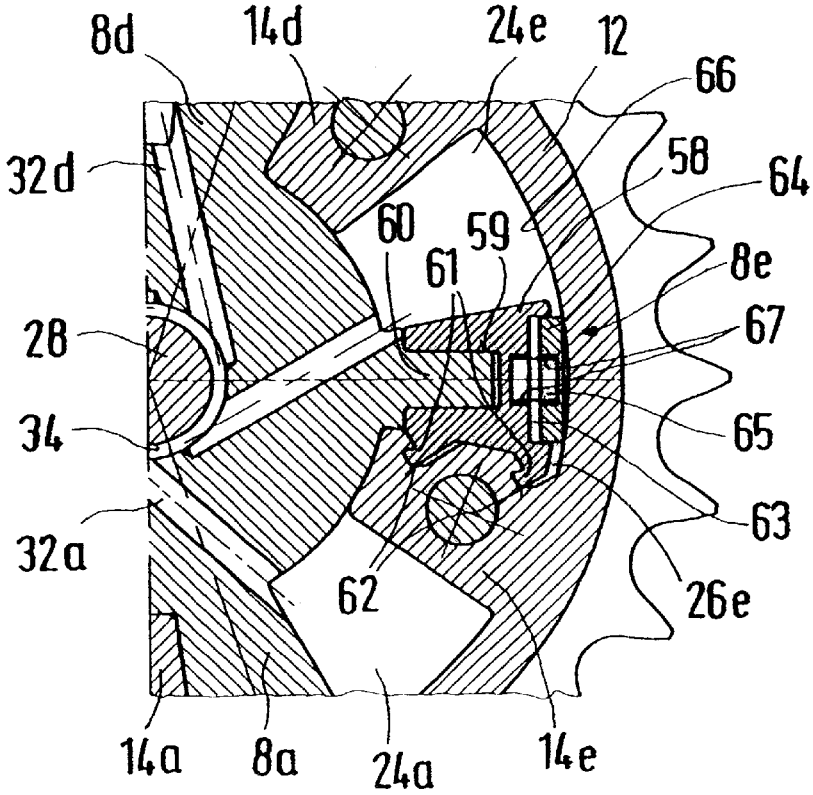
FIGS. 5*a* to 8*b* illustrate enlarged representations corresponding to FIGS. 1*b* to 4*c*.
Figure 5B:
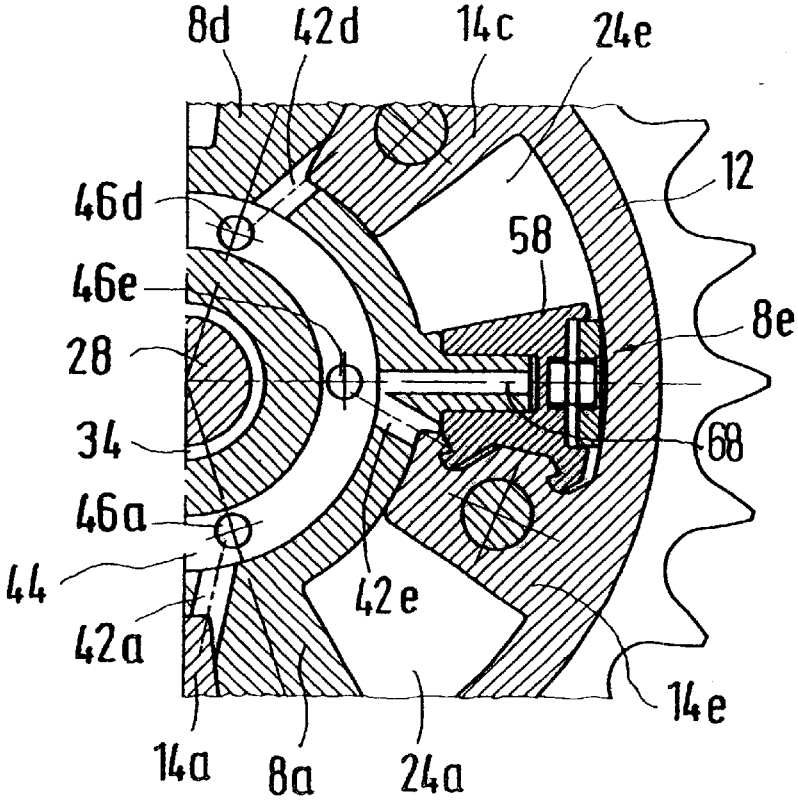

In FIGS. 5A and 5B, the internal-combustion engine is inoperative, that is, has stopped operating. The hook-shaped elements 61 of the head part 58 engage in the openings 62. The adjusting unit 6 is therefore in its locked end position, which corresponds to an "early" opening or closing time of the outlet valves of the internal-combustion engine operated by way of cams and cam followers. During the starting operation until the rotational idling speed (for example, 800/min.) has been reached, the control valve 52 remains unenergized, so that oil is supplied by way of the control line A to the pressure spaces 24*a* to 24*e*. As a result, the interior part 4 rests with its blades 8*a* to 8*c* in its locked position against the webs 14*a* to 14*e* of the cell wheel 12 as shown in FIGS. 1A–1C.

Figure 2A:
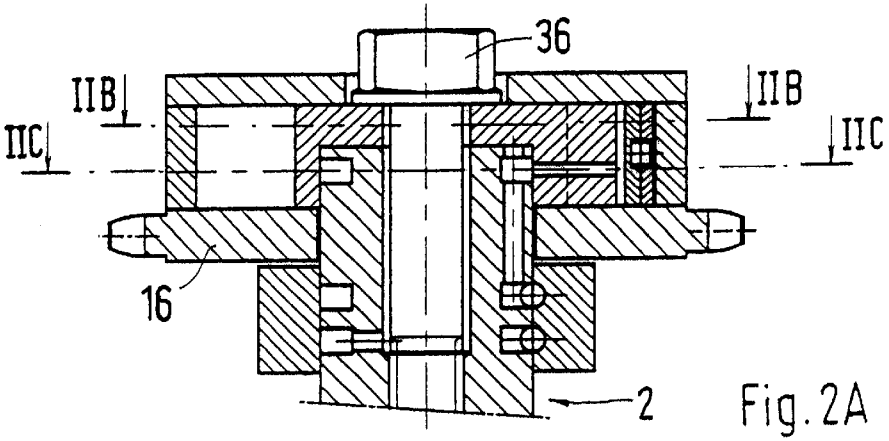
FIG. 2*a* shows a longitudinal sectional view of the adjusting unit in the unlocked position.
Figure 2B:
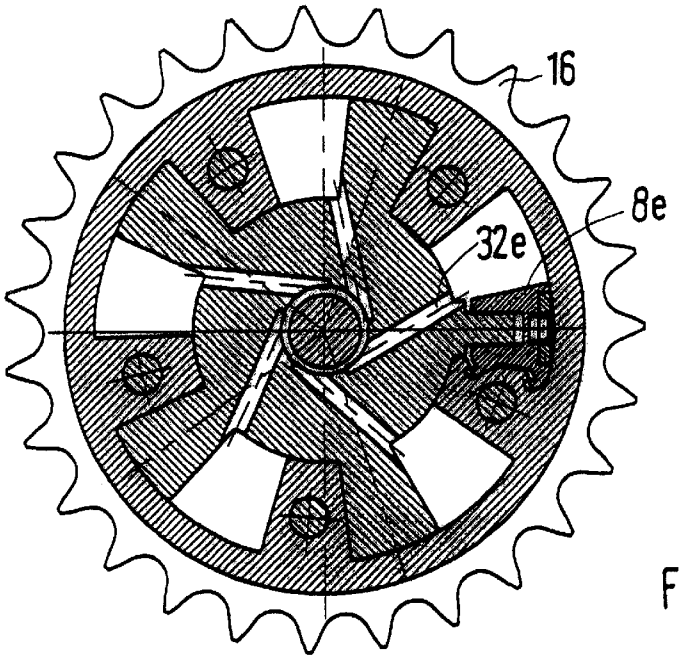
FIG. 2*b* shows a sectional view along Line IIB—IIB in FIG. 2*a;*
Figure 2C:
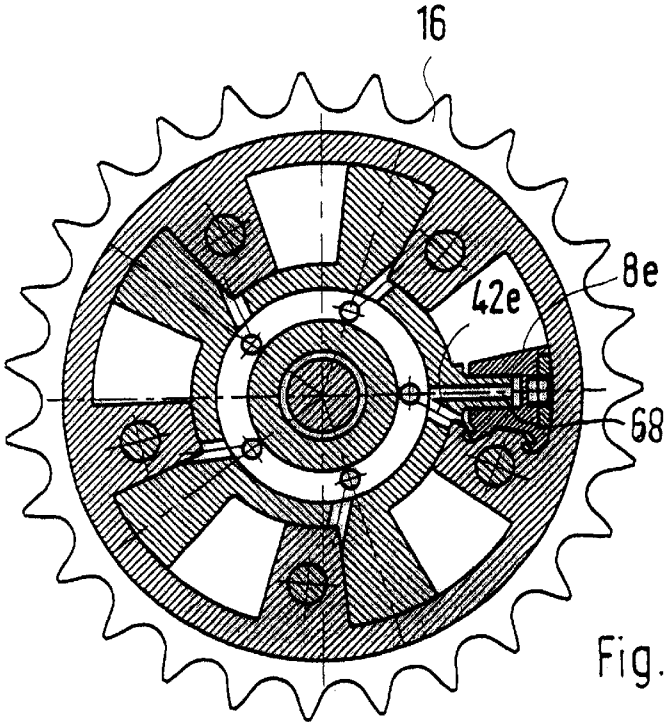
FIG. 2*c* shows a sectional view along Line IIC—IIC in FIG. 2*a;*
Figure 6A:
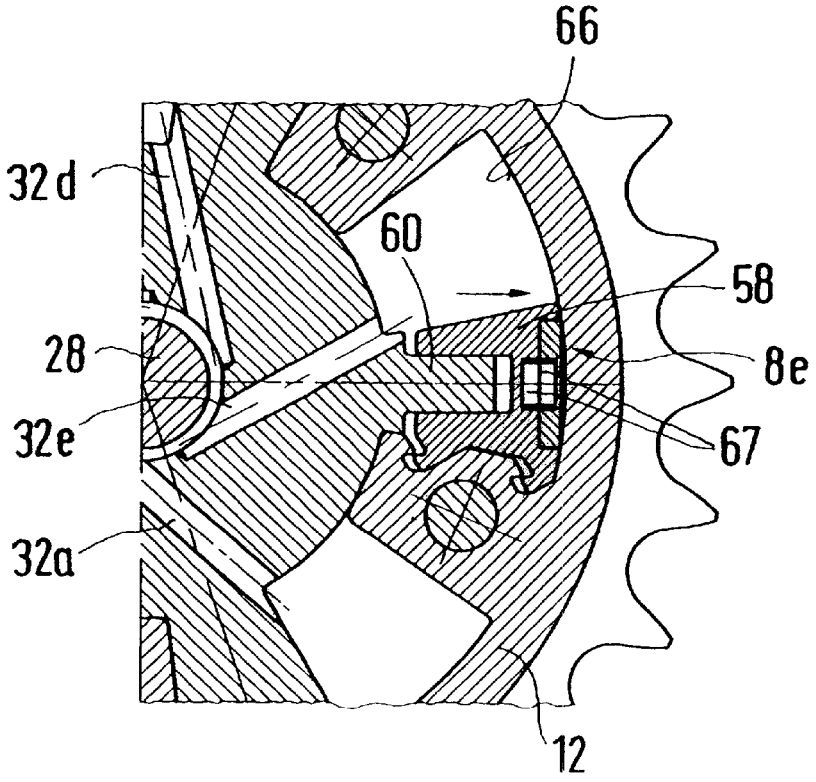
Figure 6B:
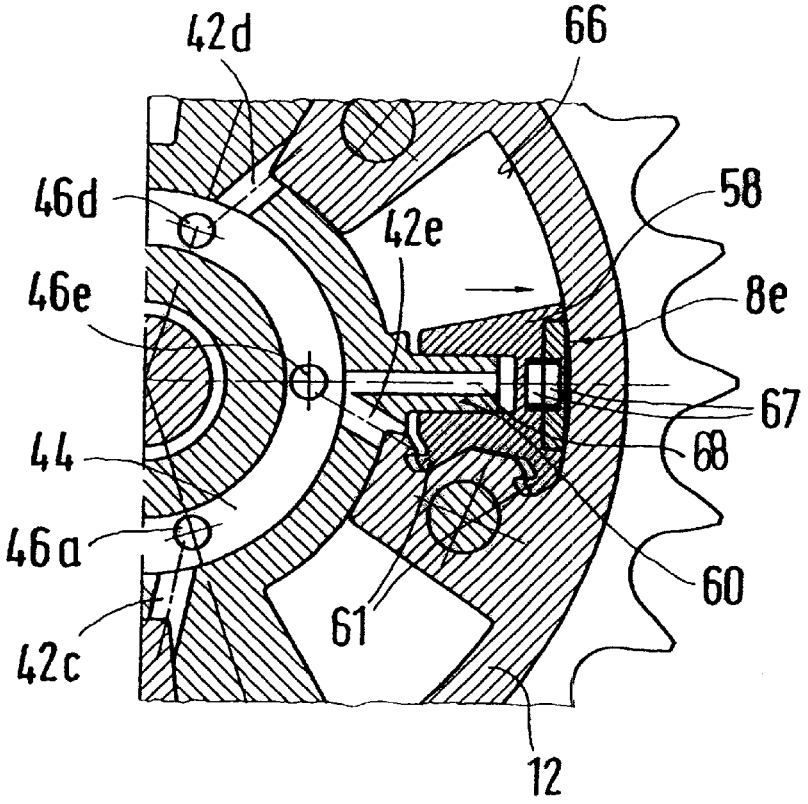

In FIGS. 6A and 6B, when the engine has reached a rotational speed at which an adjustment of the camshaft 2 in the "late" direction is desirable, the control valve 52 will be energized. The oil pressure supply therefore takes place by way of the control line B which, by way of the ring groove 48, supplies the axial bores 46*a* to 46*e*, the ring groove 44, the radial bores 42*a* to 42*e* and the pressure spaces 26*a* to 26*e* with oil. Simultaneously, oil is supplied by way of the ring groove 44 and the bore 46*e* to the supply duct 68 arranged in the shank part 60 of the blade 8*e*. As a result, by way of the hydraulic admission of pressure as well as by the centrifugal force acting upon the blades 8*e*, a radial longitudinal displacement of the head part 58 is achieved relative to the shank part 60 in the direction of the interior wall 66 of the cell wheel 12 in the direction of the arrow. The hook-shaped locking elements 61 are thereby changed from their locked position into an unlocked position as shown in FIGS. 2A–2C.

Figure 3A:
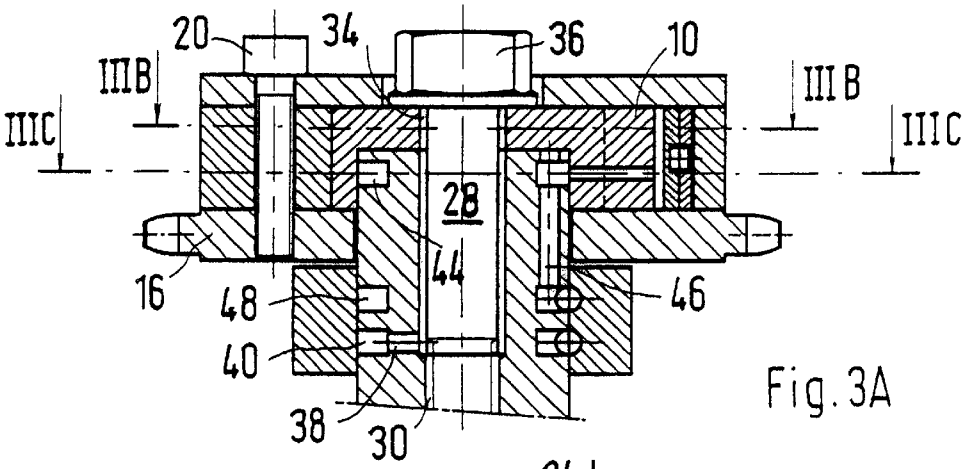
FIG. 3*a* shows a longitudinal sectional view of the adjusting unit in an adjusting position.
Figure 3B:
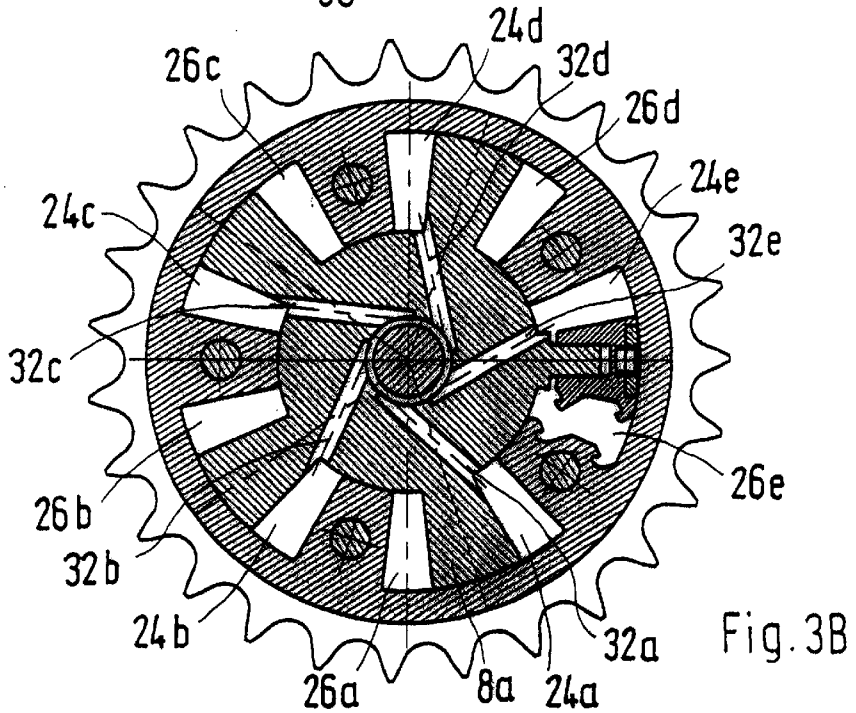
FIG. 3*b* shows a sectional view along Line IIIB—IIIB in FIG. 3*a;*
Figure 3C:
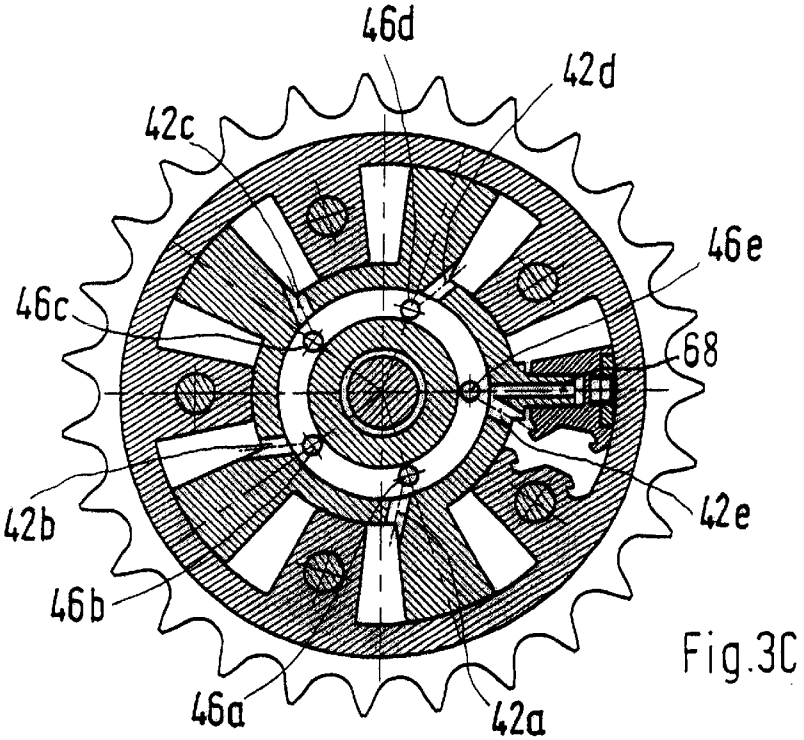
FIG. 3*c* shows a sectional view along Line IIIC—IIIC in FIG. 3*a;*
Figure 7A:
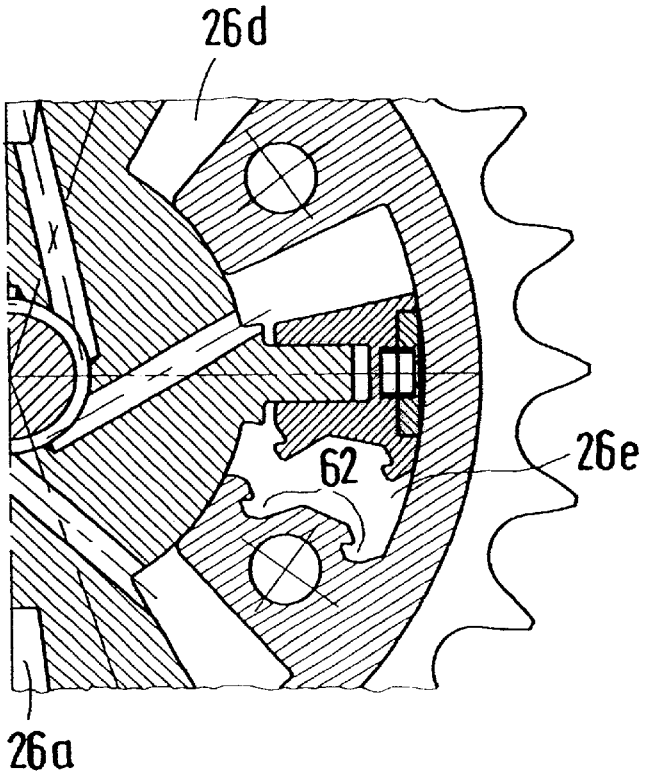
Figure 7B:
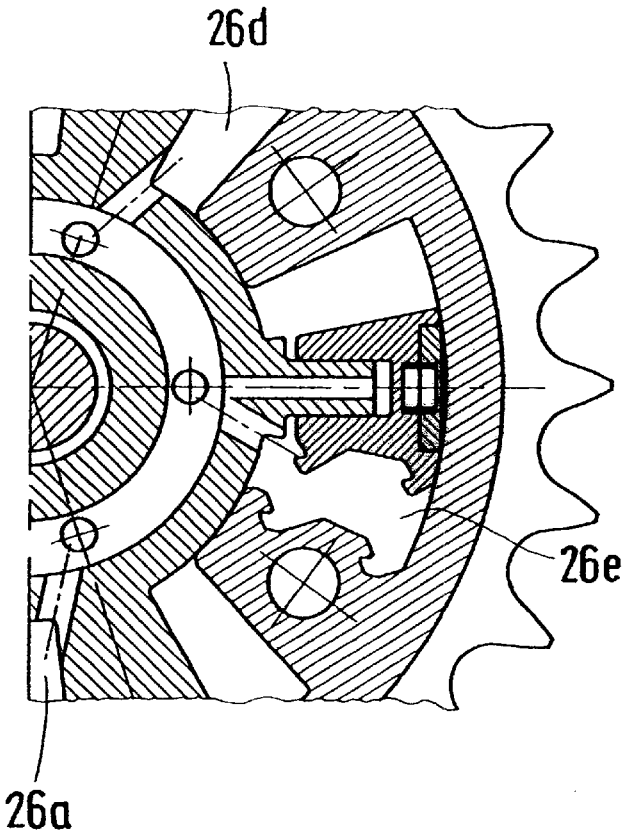

In FIGS. 7A and 7B, the rotational engine speed continues to increase so that the oil pressure in the pressure chambers 26*a* to 26*e* will also rise, so that the interior part 4 or the rotor of the camshaft adjusting device continues to be adjusted counterclockwise as shown in FIGS. 3A–3C.

Figure 4A:
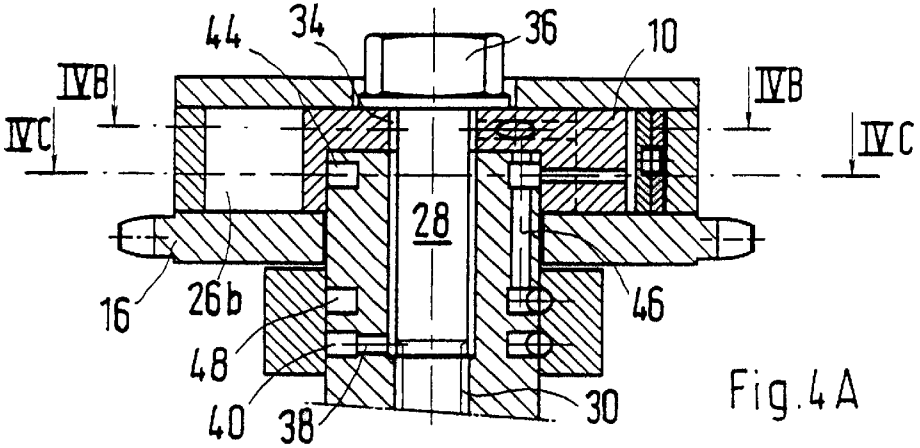
FIG. 4*a* shows a longitudinal sectional view of the adjusting unit in an unlocked end position.
Figure 4B:
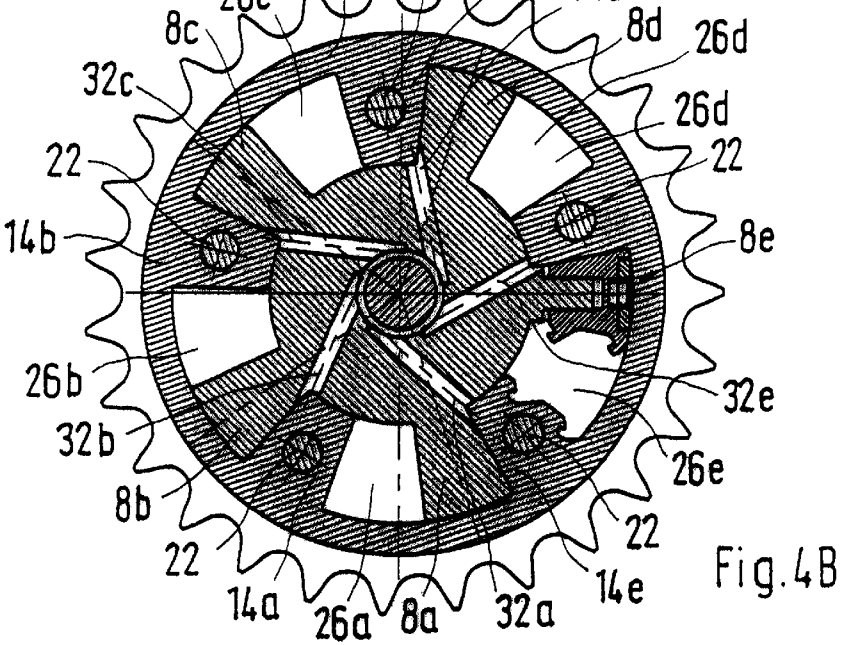
FIG. 4*b* shows a sectional view along Line IVB—IVB in FIG. 4*a;*
Figure 4C:
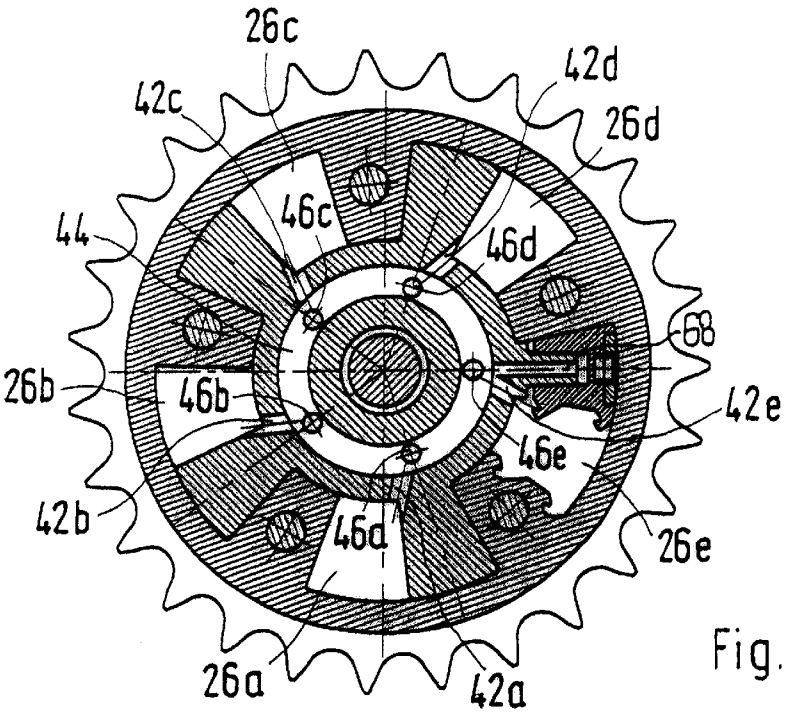
FIG. 4*c* shows a sectional view along Line IVC—IVC in FIG. 4*a;*.
Figure 8A:
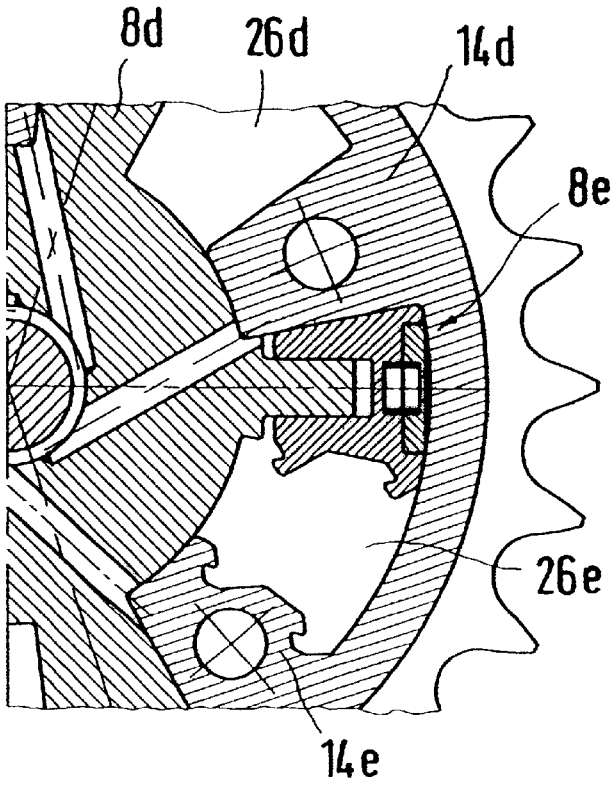
Figure 8B:
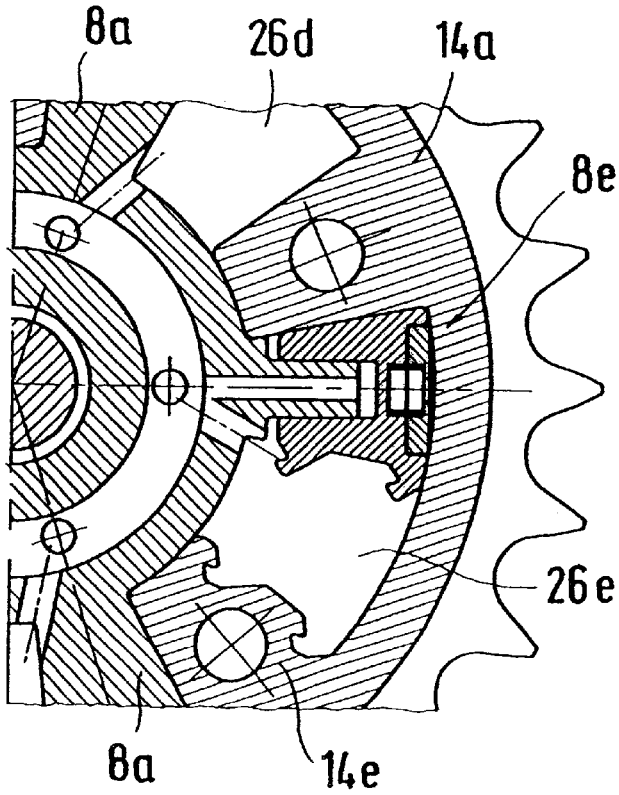

In FIGS. 8A and 8B, the rotational engine speed has reached a value at which the oil pressure in the pressure spaces 26*a* to 26*e* rising proportionally with the rotational engine speed causes the blades 8*a* to 8*e* of the interior part 4 to rest against the webs 14*a* to 14*e* of the cell wheel 12. Thus, the maximal adjusting path of the camshaft adjusting device has been reached as shown in FIGS. 4A–4C.

As a result of the used 4/2 proportional control valve 52, an alternating control of the pressure spaces 24*a* to 24*e* and 26*a* to 26*e* respectively is possible, so that arbitrary intermediate positions between the two end positions can be taken up and held. However, the hydraulic controlling of the camshaft adjusting device can also take place in a different manner. Thus, for example, a two-point control is also possible, in which the camshaft adjusting device can be adjusted only between its two end positions. Furthermore, the coordination of the operating forces required for the unlocking of the blade 8*e* can also be designed in a different manner.

Thus, it is, for example, conceivable that the radial unlocking movement of the head part 58 is caused only on the basis of the centrifugal forces acting upon the blades 8*e*, for example, with the reaching of the rotational idling speed. The arrangement is therefore not limited to the hydraulic control described in the embodiment. It is also possible to equip, instead of the one movably constructed blade 8*e*, also the other blades 8*a* to 8*d* analogously with a locking unit corresponding to the blade 8*e* and the web 14*e*. In addition, it is also possible to provide the blade 8*e* with locking elements also on its other side, which locking elements will then engage in corresponding openings provided in the web 14*d* analogous to the web 14*e* when this end position is reached.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Assembly for a relative angle-of-rotation adjustment of a camshaft of an internal-combustion engine with respect to a driving wheel, comprising:

an interior part which is non-rotatably connected with the camshaft and which has at least approximately radially extending blades, a driven cell wheel which has cells which are distributed along a circumference, are bounded by webs and can be divided into two pressure spaces by the blades guided in the cells in an angularly movable manner, during the admission or discharge of hydraulic pressure to or from the pressure spaces by way of control lines, the camshaft being rotatable by way of the blades between two end positions relative to the cell wheel, and at least one locking device which is operative between the interior part and the cell wheel, thereby the interior part can be locked with respect to the cell wheel in at least one of the end positions, wherein at least one of the blades of the interior part has a head part having at least one locking element which interacts with a locking structure of the cell wheel and is changeable as a function of operating parameters from a locked position into an unlocked position, and wherein the locking structure is arranged on at least one of the webs of the cell wheel.

2. Assembly according to claim 1, wherein the head part is radially longitudinally displaceable.

3. Assembly according to claim 2, wherein the head part can be changed from the locked position by way of an oil pressure admission into the unlocked position with respect to the cell wheel.

4. Assembly according to claim 2, wherein the head part has hook-shaped elements which, in the locked position, engage in openings in the web of the cell wheel, said openings corresponding to a contour of the hook-shaped elements.

5. Assembly according to claim 4, wherein a face of the head part has a rectangular recess into which a plate-shaped sealing and guiding element engages, the sealing and guiding element being supported on an interior side of the cell wheel.

6. Assembly according to claim 2, wherein a face of the head part has a rectangular recess into which a plate-shaped sealing and guiding element engages, the sealing and guiding element being supported on an interior side of the cell wheel.

7. Assembly according to claim 2, wherein the head part can be operatively changed from the locked position by way of centrifugal forces.

8. Assembly according to claim 1 wherein the head part can be changed from the locked position by way of an oil pressure admission into the unlocked position with respect to the cell wheel.

9. Assembly according to claim 8, wherein the head part has hook-shaped elements which, in the locked position, engage in openings in the web of the cell wheel, said openings corresponding to a contour of the hook-shaped elements.

10. Assembly according to claim 8, wherein a face of the head part has a rectangular recess into which a plate-shaped sealing and guiding element engages, the sealing and guiding element being supported on an interior side of the cell wheel.

11. Assembly according to claim 1, wherein the head part can be operatively changed from the locked position by way of centrifugal force.

12. Assembly for a relative angle-of-rotation adjustment of a camshaft of an internal-combustion engine with respect to a driving wheel, comprising:

an interior part which is non-rotatably connected with the camshaft and which has at least approximately radially extending blades, a driven cell wheel which has cells which are distributed along a circumference, are bounded by webs and can be divided into two pressure spaces by the blades guided in the cells in an angularly movable manner, during the admission or discharge of hydraulic pressure to or from the pressure spaces by way of control lines, the camshaft being rotatable by way of the blades between two end positions relative to the cell wheel, and at least one locking device which is operative between the interior part and the cell wheel, thereby the interior part can be locked with respect to the cell wheel in at least one of the end positions, wherein at least one of the blades of the interior part has a head part having at least one locking element which interacts with a locking structure of the cell wheel and is changeable as a function of operating parameters from a locked position into an unlocked position, and wherein the head part is longitudinally displaceably disposed on a shank part of the blade.

13. Assembly according to claim 12, wherein the head part can be changed from the locked position by way of an oil pressure admission into the unlocked position with respect to the cell wheel.

14. Assembly for a relative angle-of-rotation adjustment of a camshaft of an internal-combustion engine with respect to a driving wheel, comprising:

an interior part which is non-rotatably connected with the camshaft and which has at least approximately radially extending blades, a driven cell wheel which has cells which are distributed along a circumference, are bounded by webs and can be divided into two pressure spaces by the blades guided in the cells in an angularly movable manner, during the admission or discharge of hydraulic pressure to or from the pressure spaces by way of control lines, the camshaft being rotatable by way of the blades between two end positions relative to the cell wheel, and at least one locking device which is operative between the interior part and the cell wheel, thereby the interior part can be locked with respect to the cell wheel in at least one of the end positions, wherein at least one of the blades of the interior part has a head part having at least one locking element which interacts with a locking structure of the cell wheel and is changeable as a function of operating parameters from a locked position into an unlocked position, and wherein the head part has hook-shaped elements which, in the locked position, engage in openings in the web of the cell wheel, said openings corresponding to a contour of the hook-shaped elements.

15. Assembly for a relative angle-of-rotation adjustment of a camshaft of an internal-combustion engine with respect to a driving wheel, comprising:

an interior part which is non-rotatably connected with the camshaft and which has at least approximately radially extending blades, a driven cell wheel which has cells which are distributed along a circumference, are bounded by webs and can be divided into two pressure spaces by the blades guided in the cells in an angularly movable manner, during the admission or discharge of hydraulic pressure to or from the pressure spaces by way of control lines, the camshaft being rotatable by way of the blades between two end positions relative to the cell wheel, and at least one locking device which is operative between the interior part and the cell wheel, thereby the interior part can be locked with respect to the cell wheel in at least one of the end positions, wherein at least one of the blades of the interior part has a head part having at least one locking element which interacts with a locking structure of the cell wheel and is changeable as a function of operating parameters from a locked position into an unlocked position, and wherein a face of the head part has a rectangular recess into which a plate-shaped sealing and guiding element engages, the sealing and guiding element being supported on an interior side of the cell wheel.

16. A camshaft assembly for valve opening adjustment of a camshaft of an engine, comprising:

a rotor connected non-rotatably with the camshaft having approximately radially extending blades, a cell wheel having at least two cells distributed circumferentially around the cell wheel, said cells being bounded by webs and divided into two pressure chambers by the blades which are angularly moveably guided in the cells by hydraulic pressure operatively supplied via control lines, the camshaft being relatively rotatable by the blades between two end positions, and at least one locking device operatively locking the rotor with respect to the cell wheel in at least one of the end positions, wherein at least one of the blades has a head portion having at least one locking element which interacts with a locking structure of the cell wheel, and which is displaceable as a function of operating parameters between a locked and an unlocked position, and wherein the locking structure is arranged on at least one of the webs of the cell wheel.

17. Camshaft assembly according to claim 16, wherein the cell wheel is driven by a driving wheel, and the head part is radially displaceable by way of hydraulic pressure.

18. A method of making an assembly for a relative angle-of-rotation adjustment of a camshaft of an engine with respect to a driving wheel, comprising:

non-rotatably connecting a rotor having at least approximately radially extending blades with the camshaft, arranging a driven cell wheel having cells which are distributed around a circumference of the cell wheel and bounded by webs, so that the cells are operatively dividable into two pressure spaces by the blades which are operatively guided in the cells in an angularly movable manner by admission or discharge of hydraulic pressure to or from the pressure spaces by way of control lines thereby the camshaft is operatively rotatable by way of the blades between two end positions relative to the cell wheel, and providing at least one of the blades with a head part having at least one locking element which operatively interacts with a locking structure on at least one of the webs to thereby lock the rotor with respect to the cell wheel in at least one of the end positions, wherein the head part is radially longitudinally displaceable as a function of operating parameters from a locked position into an unlocked position.

19. Method according to claim 18, wherein the head part is longitudinally displaceably disposed on a shank part of the blade.

20. Method according to claim 18, wherein the head part includes a bias which operatively resists a change by way of oil pressure from the locked position into the unlocked position.

21. A method of operating a camshaft assembly for a relative angle-of-rotation adjustment of a camshaft of an engine with respect to a driving wheel, comprising:

locking an interior part which is non-rotatably connected with the camshaft and which has at least approximately radially extending blades, with respect to a driven cell wheel which has cells which are distributed around a circumference and are bounded by webs, by way of at least one of the blades which has a headpart having at least one locking element interacting with a locking structure on at least one of the webs, in one of two end positions, unlocking the interior part with respect to the cell wheel by radially longitudinally displacing the head part by way of one of centrifugal force and oil pressure acting on the headpart by which the headpart is displaceable as a function of operating parameters from a locked position into an unlocked position, and rotating the camshaft between the two end positions relative to the cell wheel by way of the blades which operatively divide the cells into two pressure spaces and are guided in the cells in an angularly movable manner, by admission or discharge of hydraulic pressure to or from the pressure spaces by way of control lines.

* * * * *